United States Patent [19]

Takabayashi et al.

[11] Patent Number: 5,043,756

[45] Date of Patent: Aug. 27, 1991

[54] AUTOMATIC DEVELOPING APPARATUS FOR A PHOTOSENSITIVE MATERIAL

[75] Inventors: Naoki Takabayashi, Hino; Shigeharu Koboshi, Sagamihara; Nobutaka Goto, Kashiwa; Masayuki Kurematsu, Hino, all of Japan

[73] Assignee: Konica Corporation, Tokyo, Japan

[21] Appl. No.: 433,370

[22] Filed: Nov. 9, 1989

Related U.S. Application Data

[63] Continuation-in-part of Ser. No. 397,858, Aug. 24, 1989, abandoned.

[30] Foreign Application Priority Data

Feb. 31, 1988 [JP] Japan ..... 63-217436
Feb. 31, 1988 [JP] Japan ..... 63-217437

[51] Int. Cl.[5] ..... G03D 3/02; G03D 3/08

[52] U.S. Cl. ..... 354/320; 354/324; 354/331

[58] Field of Search ..... 354/316, 320, 321, 322, 354/323, 324, 328, 331, 332, 336

[56] References Cited

U.S. PATENT DOCUMENTS

| | | | |
|---|---|---|---|
| 3,057,282 | 10/1962 | Luboshez | 354/305 |
| 3,273,485 | 9/1966 | Limberger | 354/336 |
| 3,330,196 | 7/1967 | Chen et al. | 354/318 |
| 3,379,113 | 4/1968 | Hosoya et al. | 354/331 |
| 4,166,689 | 9/1979 | Schausberger et al. | 354/322 |
| 4,178,089 | 12/1979 | Spence-Bate | 354/324 |
| 4,324,479 | 4/1982 | Sachs | 354/324 |
| 4,616,915 | 10/1986 | Norris | 354/331 |

*Primary Examiner*—A. A. Mathews
*Attorney, Agent, or Firm*—Finnegan, Henderson, Farabow, Garrett, and Dunner

[57] ABSTRACT

Disclosure is an automatic processing apparatus for processing a silver halide photosensitive material with a processing agent, comprising: a processing tank for containing the processing agent, conveyance rollers for conveying the photosensitive material through the processing tank, and a sealing device for preventing the processing agent in the processing tank from coming into contact with air, wherein the processing tank has a tube shape.

45 Claims, 9 Drawing Sheets

AUTOMATIC DEVELOPING APPARATUS FOR A PHOTOSENSITIVE MATERIAL

This is a continuation-in-part of application Ser. No. 07/397,858 filed Aug. 24, 1989, now abandoned.

BACKGROUND OF THE INVENTION

This invention relates to an automatic developing apparatus for a photosensitive material, and more particularly to a rapid processing automatic developing apparatus or a compact automatic developing apparatus which has been improved to effectively prevent oxidation or deterioration of processing solutions, and which provides troublesome free cleaning maintenance of conveyance rollers.

Conventional automatic developing apparatus for processing photosensitive materials such as photographic films and papers, range from a large-sized apparatus such as a large-sized central processing installation, which will herein be referred to as a large-sized laboratory, to a comparatively small size apparatus used in a small shop, which will herein be referred to as a minilaboratory. Further small-sized developing apparatuses are also concerned, well-known types being a self-service developing apparatus to process a direct positive photograph by use of identification cards and so forth, a developing apparatus to process X-ray films, and a super small-sized developing apparatus which includes manual operation.

In conventional automatic developing apparatus, it is common to store processing solutions in processing tanks, convey the photosensitive materials to the processing tanks using a conveyance rack or a guide plate and so on, and to process the photosensitive materials by dipping them in the processing solution in the tank. This may be referred to as the immersion processing system.

In the case of comparatively small-sized automatic developing apparatus, there are variations on the immersion processing system. They are: processing photosensitive materials by conveying them through a processing solution stored in a tubular processing tank; conveying photosensitive materials horizontally with the photographic emulsion side downward in order to contact them with processing solutions; coating processing solutions on the photographic emulsion side with rollers; and spraying processing solution over the emulsion side from below.

When a processing solution is left exposed to air, it reacts with oxygen in the air to become oxidized and deteriorated, and thereby the processing efficiency of the solution is seriously affected.

In a large-sized automatic developing apparatus, a processing tank can store a large quantity of a processing solution, which is more than 10 liters. The ratio of the surface area of the solution to the quantity of the solution is small, and a large open space is left in the top of the processing tank after a lid is put in place.

In a small-sized automatic developing apparatus, when the quantity of solution stored in the tank is more than 4 liters, which is comparatively large, the same countermeasure as for the large-sized automatic developing apparatus can be applied, or a floating lid can be set on the upper surface of the solution as disclosed in Japanese Patent Publication Open to Public Inspection No. 27968/1979.

This invention aims at a small-sized developing machine which stores less than 2 liters of solution in its processing tank. In this case, the ratio of the surface area of the solution to the quantity of the solution is large. Whereas in conventional apparatuses, even if a lid is put on the top of the storage tank, the processing solution continues to be oxidized by the air existing between the lid and the surface of the solution. For that reason, for instance, as shown in U.S. Pat. No. 3,273,485, Japanese Patent Publication Open to Public Inspection No. 28338/1985, and so forth, a method is proposed in which the processing solution stored in a processing tank is fed to a tubular tank and photosensitive materials are conveyed through the tube to be processed. As disclosed in U.S. Pat. No. 3,330,196, a method is proposed in which the processing solution is soaked up by coating rollers and coated on photosensitive materials.

In the case of conventional automatic developing apparatus where processing solution is stored in the processing tank and photosensitive materials are conveyed by a conveyance rack or a guide plate to be dipped in the solution, i.e. the immersion processing system, the solution adheres to the photosensitive materials, and transfers to conveyance rollers located at the delivery side of the processing tank and the adhered solution hardens when the apparatus is not used. The solution adhered to the rollers affects processing efficiency and normal conveyance of photosensitive materials when the apparatus is next operated.

Therefore, in a conventional large-sized automatic developing machine, maintenance is necessary, such as taking apart the conveyance rollers before or after operation and cleaning them with water.

In order to reduce troublesome roller cleaning work, in an automatic developing apparatus known as PCC, for example the Color Seven Copy Machine manufactured by Konica; the following method is adopted. First of all, a cleaning roller is set to come into contact with a conveyance roller with pressure, and dirt on the conveyance roller is transferred to the cleaning roller. In an automatic developing apparatus for an X-ray film, a method to convey a cleaning paper through the conveyance rollers in advance to remove dirt from them, is in practical use. A method to wind a cleaning paper round the conveyance roller, is proposed.

Recently, minilaboratories are spreading. As a result, it is possible to pick up finished phtos within an hour at some DPE (developing, printing, and enlarging of phtographs) shops. In spite of the appearance of these minilaboratories, about 75% of films and photographic papers are processed at large-sized laboratories.

However, in the case of a large-sized laboratory, there is a limit to the reduction of its finishing time because collection and delivery are conducted through agents. If minilaboratories spread widely in the future, super rapid processing in which all processing is finished within an hour, will become a common concept and it is thought that many films and photographic papers will be processed at minilaboratories.

When we survey the future, it is thought that the technology of automatic developing apparatus will advance from processing at a minilaboratory to self-service DPE processing, in which a small-sized automatic developing apparatus similar to office automation equipment will be used.

In this kind of processing system, an automatic developing apparatus must be located not only at specialty stores like the conventional minilaboratories, but also at various places where office automation equipment is located. Accordingly, it is anticipated that the automatic developing apparatus will have to be smaller than the minilaboratory used now.

The minilaboratory which is used now is pretty large although it is called small-sized. Therefore it cannot be located in a small store, and it requires skilled operation. An operator must be skillful at treating photosensitive materials and processing solutions, at adjustment work when a jam occurs in the apparatus, and at maintenance work, such as cleaning of rollers and filters. As expressed above, the minilaboratory can not be installed in a small shop because of space limitations and skill restrictions.

The requirements for an automatic developing apparatus to be used in a future processing system are that it must be super small-sized and light, maneuverable, simple in its mechanism and troubleproof. Furthermore, the requirements for the apparatus are that it uses a small quantity of processing solution, it discharges small amounts of waste fluid and waste matter, it smells as little as possible, it seldom causes vibration, it scarcely make a noise, and it can be manufactured at a reasonable cost.

The inventors earnestly studied and improved the automatic developing apparatus to meet the requirements explained above and succeeded in completing the present invention. The first object of the invention is to reduce the amount of processing solutions to be as little as possible and to effectively prevent processing solutions from oxidization and deterioration, which are particularly remarkable when the quantity of solution is small.

The inventors further conducted a diverse investigation and found that when the conveyance speed of photosensitive materials to be processed is less than 5 cm/min, maintenance of the conveyance rollers is not necessary, but when the speed is 5 cm/min to 100 cm/min, cleaning maintenance of the conveyance rollers is indispensable.

Thus, the second object of the present invention is to provide an automatic developing apparatus, the conveyance rollers of which are easily cleaned for maintenance. Other and further objects, features and advantages of the invention will appear more fully from the following description.

The following description concerns the third problem. In the category of comparatively smaller sized automatic developers, there is an application example of soaked-in processing method, whose technology (i.e., solution is stored in the processor tank or bath formed in a slit, and photographic sensitized material or photosensitive material is transported through this slit for processing in contact with solution) was publicized in the Patent Disclosure (Japanese Patent Publication Open to Public Inspection) No. 131138, 1988.

It is mentioned in the disclosure that with this technology, deterioration of solution is minimized because the [aperture area "S" on the solution surface/processor tank capacity "V"] ratio is small. This invention of which aperture section is designed in a slit (thin) to comply with the cross section of sensitized material, however, presents such a drawback that the size of the auto developer cannot be made smaller because an amazingly lengthy processor tank (to increase "V") is required in order to lessen the aperture area "S". Meanwhile, an attempt to reduce the size of machine (that is, to decrease "V") is accompanied by the need of making the aperture area "S" at the entrance of material extraordinarily smaller, plus, by another problem (for instance, crystallized substance will be readily separated, or scratches will be readily produced on photographic sensitized material). Especially when processing a thin, lengthy material such as color film, there was detected a critical defect that the processing performance for the material results in completely differing between 'immediately after' the processing start and 'just prior' to its end. Further, if the treatment is carried out employing the same solution as used in a large-sized auto developer, the use of a machine based on a slit-shaped tank was found out to necessitate a longer period of processing time in order to obtain the same performance to the large-sized unit. It was concluded that such slit-tank unit is not suitable for speedy processing.

Another example of this type of slit-tank unit is found in the Patent Disclosure No. 259661, 1988. With this technology, the material transport speed in the tank is faster than the flow of solution, further, the solution flow and the material transport are in opposite directions. The solution newly supplied comes in contact with the material transported in opposite directions at the exit of the tank, but because the movement direction of the solution and material is reversed, the liquid surface level in a narrow slit-tank unit loses stability, in other words, in many cases, the solution overflows. Accordingly, it is difficult to keep the surface level stabilized. Meanwhile, when the leading portion of the material enters the slit tank, a resistance is caused against the direction of transport, then, it was found that the resistance, provides a disorder such as jamming because the material is not transported smoothly. Another significant drawback was recognized in terms of assured material transport, particularly when treating "thin type" ones such as a film base with the thickness less than 150 $\mu$m of a color paper with the thickness less than 200 $\mu$m A technology concerning this kind of developer is publicized in the U.S. Pat. No. 3,273,485. In case of this developer, an extra tank connected to such type of thin, lengthy slit-shaped processing tank, is provided under the processor unit, and if the solution is not used for a longer period, it can be stored in the extra tank.

With this technology, however, there is a drawback that the remaining solution attached in the slit tank is solidified and crystallized objects are generated. As the same in the case of the technology stated in the Patent Disclosure No. 131138, 1988, the slit structure of its tank offers such drawbacks as irregularity in development, desilvering and rinsing, and unappropriateness for use in speedy treatment. It was found in conclusion that this technology is not suitable for development of photo sensitized materials.

In addition, the Patent Disclosure No. 178965, 1989 publicizes a sensitized material treatment device equipped with a shallow developing tank and an extra tank filled with the solution shut out from open air, and incorporating a circulation means to permit solution circulation between the processing tank and the extra one. As this unit utilizes a shallow tank, the aperture area in the upper portion of the tank cannot help being designed larger in size, thereby causing a problem of deterioration in solution. As a remedial measure, a floating lid is provided to avoid oxydization of solution. Yet, it still presents such a drawback that a thin membrane is formed on the float by the solution whenever the float fluctuates because a perfect hermetically sealing measure is not taken, which might easily "accelerate" further oxydization. Especially when treating with a small volume of solution, deterioration of the solution becomes remarkable.

Compact design of each tank may realize miniaturization of the developing unit itself, but if it should end in adversely affecting photographic performance of treated materials, the importance of photography itself would be lost. There exists a number of factors to give influence on photographic performance. In the invention concerned which has a structure of substantial, hermetical sealing, the important points are, among others, the agitation effect and accuracy of temperature control of the solution in the processor tank. Meanwhile, as more compact design of auto developer is achieved, the volume of solution is reduced that much. In this regard, the point is how to maintain solution stability against various kinds of deterioration, for instance, caused by oxydization or evaporization-originated incrassation.

Further, treatment of silver halide photographic sensitized materials should be carried out in total darkness. Unit miniaturization would make, however, the solution supply port and material removal port far closer in distance to the processing tank, causing a difficulty to maintain an appropriate property of light shielding in the processor.

SUMMARY OF THE INVENTION

The first embodiment to accomplish the first object of the present invention is described as follows. In an automatic developing apparatus, a processing tank is formed in the shape of a tube and processing solution is supplied to the tubular tank. Photosensitive materials are conveyed to the tank to be developed. A means of tightly sealing the solution is installed at the top of the tank, close to the surface of the solution. The sealing means comprises conveyance rollers which are located at the top of the entry side and delivery side of the tank close to the surface of the solution. In this case, the chemical storage tank is sealed up tightly by the conveyance rollers. Another sealing means consists of a movable plate which moves across the upper aperture of the tank and seals off the upper portion of the tank, close to the surface of the solution. A further sealing means consists of a cylindrical valve with a slit for conveyance which seals off the upper portion of the tank close to the surface of the solution. Another sealing means is equipped with a flexible pack inside the tank and seals the solution at the upper portion in the tank. A further sealing means is constructed so as to seal the upper portion of the tank by raising the tank or by lowering of the lid member. A processing tank is formed in the shape of a tube and processing solution is supplied to the tank. At the same time, photosensitive materials are conveyed to the tank. In this case, inert gas or liquid is filled or supplied onto the surface of the solution and seals off the solution from air. The apparatus is equipped with a mechanism to discharge solution from the tank and a means of detecting the photosesitive materials conveyance condition. In this system, when photosensitive materials do not exist in the storage tank for a prescribed time, the solution is discharged from the processing tank to a storage tank to inhibit oxidation. The automatic developing apparatus to attain the first object of the present invention is a small-sized automatic developing apparatus for photosensitive materials with the features described above.

Therefore, according to the first embodiment of the present invention, the upper portion of the processing tank close to the surface of the solution is sealed from air by a sealing means or air is replaced with inert gas or liquid. Moreover, when photographic materials are not processed in the tank, the solution is removed from the tank to another tank to inhibit oxidation. Accordingly, the quantity of air which comes into contact with the solution is very small and harmful effects caused by oxygen in the air can be eliminated.

The second embodiment to attain the second object of the present invention will be described as follows.

An automatic developing apparatus for silver halide color photosensitive materials, having a conveyance speed of silver halide color paper to be processed is 5 cm/min to 100 cm/min, has the following characteristics.

Cleaning water is supplied at least to the conveyance rollers located at the delivery side of the processing tank, and the conveyance rollers are cleaned by the water. An outlet for cleaning water is located above the conveyance rollers and cleaning water is supplied from the upper part of the conveyance rollers to clean them. Cleaning water is supplied to the absorbent conveyance rollers to clean them. The conveyance rollers are cleaned by water to compensate for evaporation. The apparatus has a drain construction to discharge water used to clean the conveyance rollers through the bypass located on the upper portion of the tank. The apparatus is constructed to guide water used to clean the conveyance rollers to the processing tank in order to clean the tank. The apparatus has a construction in which water at the start of cleaning is discharged through the bypass and after a prescribed time has passed, cleaning water is guided to the processing tank. The apparatus has a mechanism as follows. A guide member to guide papers to clean the rollers is located outside the processing tank and the conveyance rollers are cleaned through a different path from that of photosensitive materials by changing the path by the guide member. The apparatus is constructed to clean the conveyance rollers and the chemical storage tank using the normal conveyance path of photosensitive materials after the processing solution is removed from the tank. A third roller is installed which comes into contact with at least one of the conveyance rollers located at the delivery side of the tank. The third roler is also used as a cleaning roller. At least the surface of the conveyance rollers located at the delivery side of the tank is covered by a hydrophobic material to be water repellent. The second embodiment of an automatic developing apparatus to attain the second object of the present invention has features explained above.

In the present invention, cleaning water is not limited only to water, but various kinds of additives may be used.

When the photosensitive materials are rapidly processed as in this embodiment at a high conveyance speed of 5 cm/min to 100 cm/min, the amount of processing solution adhered to the photosensitive materials becomes large. It has been proved that the processing solution which adheres to the conveyance rollers crystalizes when dried. It has also been proved that this tendency is remarkable when photosensitive materials are processed at a high temperature or in a high density solution.

It has also been proved that this tendency is more remarkable when the immersion time of photosensitive materials being processed at color development is at least less than 30 seconds.

In order to take a countermeasure against it, in an automatic developing apparatus of the embodiment, cleaning water is supplied to the idling conveyance rollers from the upper side or inside. As a result, the processing solution which adheres to the conveyance rollers is washed away, so the solution is never crystalized and never adheres to the rollers.

In the embodiment in which cleaning water is discharged through a bypass, the conveyance rollers are cleaned on the condition that the processing solution is stored in the processing tank. In the embodiment in which cleaning water flows into the processing tank, both the conveyance rollers and the storage tank are cleaned simultaneously.

In an embodiment in which cleaning water is not supplied, it is not necessary to remove the conveyance rollers in order to clean them. Cleaning operation is easily conducted.

As a result of ardently repeated considerations for the above mentioned third problem, the inventors of this unit has succeeded through the following processes. To achieve more compact design of an automatic developing machine, the capacity of its processor should be far less. It also leads to increase of the ratio "Aperture area of the surface of processing solution/Amount of processing solution". To avoid deterioration of processing solution due to the larger ratio, the inventors provide a solution tank outside the processing part, thereby making the ratio of "Aperture area/Processing solution volume" smaller. Further, to solve the problem of irregularity in developing performance, especially, unevenness in processing, owing to less availability in the amount of processing solution, it is necessary to agitate the processing solution by means of circulation. Accordingly, a means to circulate solution is provided between the processing part and solution tank part (the flow direction of sensitized material transport, further, the speed of solution at which it runs on the material surface, is made faster than that of material transport), simultaneously by agitating the solution during circulating flow, it has been found that it is possible to shorten the processing time.

Accordingly, the photographic sensitized material automatic developing machine of this invention, comprises a processing unit in which the photographic material is soaked during processing, a solution tank unit filled up with the processing solution which substantially doesn't come in contact with open air, and a pump to permit solution circulation at a speed faster than that of material transport between the processor and solution tank. The aperture section of the processor is characterized in that it is configured substantially to shut out air from outside. In addition, the processing method described in this invention is based on the treatment using this automatic developer.

With the use of this developing unit, photographic materials are processed while the solution is circulated (the direction is the same for both material transport and solution flow, and the speed of material transport is faster than the solution flow) between the developer's processor and an external solution tank, so that new solution controlled in predetermined temperature is always supplied to the processor, and the solution flow produces a satisfactory effect of agitation, thereby preventing eventual irregularity in development, plus, being free from causing transport trouble such as material jamming because the direction of both material and solution is identical in terms of flow. If a slit tank is used in the processor, chemicals contained in the solution (that is, principal chemical and buffering agent) will be consumed at a far faster period of time because the volume of solution is less, which is liable to provide markedly different photographic characteristics between the leader and the entailing section of a lengthy photosensitive material, or to cause partial irregularity, or to rise trouble in terms of material transport in a narrow slit tank. Employing this invention, these problems (irregularity and material transport) can be eliminated. Further, the stirring up effect brought about by bulky circulation of fresh solution enables to reduce the time required for processing. Even if the solution is stored in the processor for a longer period of time, there is no problem for the solution in the processor and the tank, such as oxygen-originated deterioration due to direct contact with open air, concentration caused by volatilization, and crystallization of processing chemicals. Accordingly, it serves to prevent unevenness in development, scratches on emulsion surface of photosensitive material and trouble in material transport.

In this invention, the solution tank unit means includes a section where materials are not processed, the same solution is filled in as in the processor, and no material is soaked in. This section is separated from the processor through some partition means. This tank is provided mainly to increase the solution capacity of the processor, being different in purpose from a so-called filter case (used for filtration) incorporated in traditional auto developers. The capacity required for this tank is sufficient if it can contain at least such an amount to permit achievement of the above-mentioned major purposes.

When treating sensitized materials, processing solution adheres to the materials, in other words, a slight amount of solution carried out with material from the processor results in being drained outside the developer. It may cause pressure reduction in the processor or the tank, allowing air entering into the developing unit. This state enables oxydization of solution to occur or to adversely affect the performance of pump drive. To solve this problem, it is desirable that the tank is made of soft flaxible organic highpolymer material so that its configuration allows free change of volume (or, inner capacity). Further, it is also possible to limit the place where air enters to the pre-determined trouble-free portions, for instance, either solution tank or processor, or merely tank/processor units.

It is further possible to make the solution tank unit doubly serve for other purposes, e.g., storage of processor solution when not in use.

It is meant by "some partition means" earlier mentioned, that separation can be carried out, either by setting up a division plate between the processor and the tank, or by providing for an independent tank separately installed.

Any type of processor, currently released on the market, can be used in combination with this invention, but it is desirable to select one whose aperture area (solution surface) is designed smaller.

Processing time can be further reduced by making the direction of solution flow in the processor unit identical to that of material transport, even if partly.

In addition, if the flow of solution in the processor is faster in speed than the transport of sensitized material, a sufficient stirring up effect for the solution and a replacement effect with fresh solution are obtainable on the material surface. For instance, when the solution flows at the speed more than 1.5 times that of material transport, the material in the processor tank always comes in contact with fresh, temperature-regulated solution coming from the separate tank, thereby eliminating the problem of irregularity in development.

It was previously related that the solution flow in the processor should be the same in direction (at least partly) to the material transport. This means, as an illustration, that for the direction of material transport to be processed, an identical direction solution flow is brought about at least in a part of material soaked-in section. Two examples of actual materialization in this connection are: soaking a rack (for material processing) in a box-shaped processor unit, solution is put in from the entrance of materials, and drained from the processor's bottom; and, it is supplied from the bottom of processor, and drained from the material exit.

It also is a recommendable measure to provide a baffle board on the rack, pour solution from the entrance of material, and drain it from the side of material exit, by which a flow pattern of material entrance—baffle board—exit, is created.

BRIEF DESCRIPTION OF THE DRAWINGS

FIG. 12 to FIG. 16(A) are schematic illustrations of the first embodiment of the present invention.

FIGS. 23 to 24-*c* are sectional views of another embodiment of the invention.

DETAILED DESCRIPTION OF THE INVENTION

Figure 1:
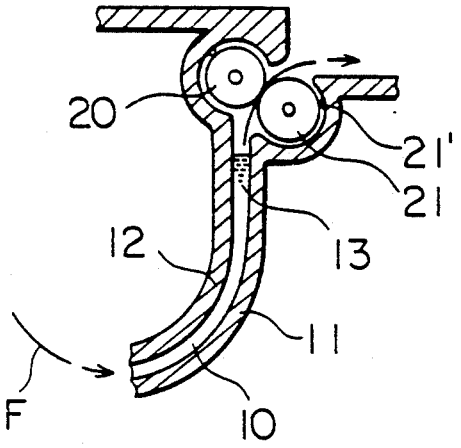
FIG. 1 to FIG. 7 are sectional views of the first embodiment of the present invention.

Referring to the drawings, the first embodiment of the present invention will be explained as follows.

FIG. 1 shows an example of the location of conveyance rollers. In this example, the processing tank is sealed up by the conveyance rollers of the entry side and delivery side which are located at the upper side of the processing tank close to the surface of solution.

In the drawing, the numeral 10 is a processing tank and it is formed into a tubular shape by the lower side member 11 and the lid member 12. Processing solution is supplied up to the liquid surface 13 by a processing solution supply means which is not shown in the drawing. Photosensitive materials F are conveyed in the arrowed direction and immersed in the solution to be processed.

The numerals 20, 21 are a pair of conveyance rollers and at least one pair are located at both the entry side and delivery side of the processing tank 10. A pair of shafts of the conveyance rollers 20 can be mounted in the lid member 12 or in the lower member 11, or only the shaft of the lower conveyance roller 21 can be installed at the lower member 11.

The lower member 11 and the lid member 12 are equipped with concave portions a little above the surface of the processing solution to locate the conveyance rollers 20. These concave portions can be made by shaping the lower member 11 and the lid member 12, or members formed in the concave shape can be attached at the lower member 11 and lid member 12.

The radius of the concave portion corresponds to the diameter of the conveyance roller 20. A space may be provided between the roller and the concave portion so as not to obstruct rotation of the roller, or a concave member independent of the lower member 11 and the lid member 12 may be provided and pressed with a soft spring toward the roller so as not to leave any space between the roller and the concave member. Furthermore, the spacer 21' which is preferably made of a material with a low coefficient of friction, is located between the roller and the concave portion to eliminate the space. In this embodiment, it is useful for the spacer 21' to constitute a cleaning member to clean the conveyance roller 20 or to constitute a squeezing member to remove the processing solution which adheres to the conveyance roller 20. Furthermore, it is also useful to install a squeezing member quite independent of these structures.

Examples shown in FIG. 2 to FIG. 6 have a sealing means which consists of a movable sealing plate mounted at the upper aperture of the processing tank close to the surface of the processing solution.

Figure 2:
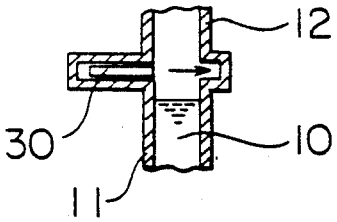

In FIG. 2, the numeral 30 is a movable sealing plate which can be moved in the direction of the arrow mark by the force of a spring, a solenoid, or pressure of fluid in order to seal up the processing tank 10.

Figure 4:
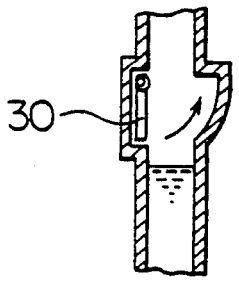
Figure 5:
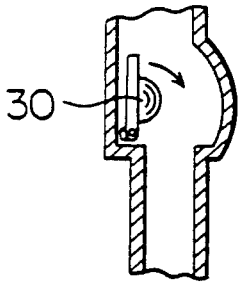
Figure 3:
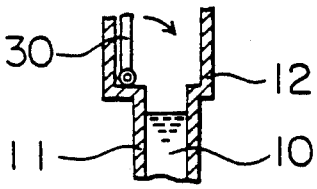

In FIGS. 3 to 5, the movabele sealing plate 30 is provided with a hinge in order to seal up the processing tank 10.

Figure 6:
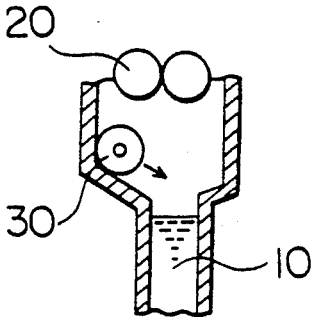

In FIG. 6, a cylinder shape movable member for sealing with a round shape section is moved to the position formed at the upper portion of the processing tank 10 in order to seal the tank 10.

Figure 7:
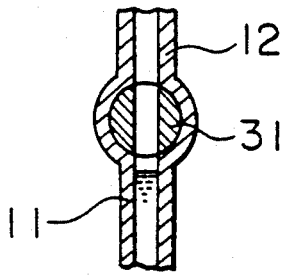
Figure 8:
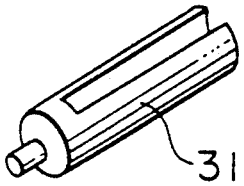
FIG. 8 is a perspective view of an element of the first embodiment of the present invention.

In FIG. 7 and FIG. 8, a cylindrical valve with a slit for conveyance located at the upper portion of the processing tank, can seal the upper portion of the tank close to the surface of the solution.

In FIG. 7 and FIG. 8, the numeral 31 is a cylindrical valve with a path inside, and this valve is located in a circular concave portion formed in the lower member 11 and the lid member 12. FIG. 7 shows the condition of the valve in which a conveyance path is formed to leave the upper side of the processing tank open. When the valve is rotated by 90 degrees, the conveyance path becomes horizontal and the upper portion of the storage tank 10 is sealed.

Figure 9:
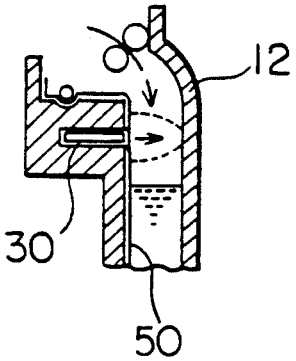

In FIG. 9, a sealing means consists of a flexible bag in the processing tank and it contains processing solution in it to seal up solution close to the upper end of the bag.

In FIG. 9, the sealing means consists of a flexible tube 50 made, for example, from plastic sheet, which lines the walls of the processing tank. The ends of this flexible inner tube are attached to the inside of the walls of the processing tank, so that, when movable plate 30 is operated to seal off the processing solution, no space is left between movable plate 30 and the surface of the processing solution.

Figure 10:
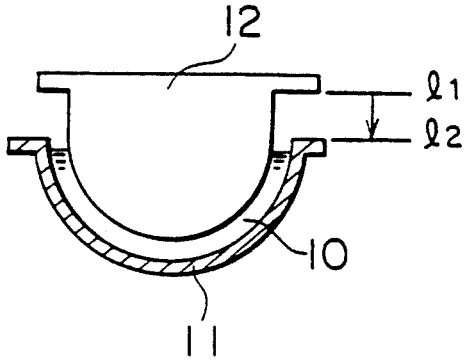
FIG. 9 to FIG. 11 are sectional views of the first embodiment of the present invention.

In FIG. 10, the sealing means is either an ascending lower member or a descending lid member.

As shown in FIG. 10, a transport path is formed by a space between the lower member 11 and the lid member 12 which are represented by $l_1$ and $l_2$. Accordingly, the upper portion of the processing tank 10 is open in this condition. By lowering the lid member 12 from $l_1$ to $l_2$ or raising the processing tank (the lower member 11) from $l_2$ to $l_1$, the upper portion of the lower member 11 comes into contact with the lid member 12, and the processing tank 10 is sealed. When this operation is conducted, the processing solution is moved to another container by a supply and discharge unit not shown in the drawing.

Figure 11:
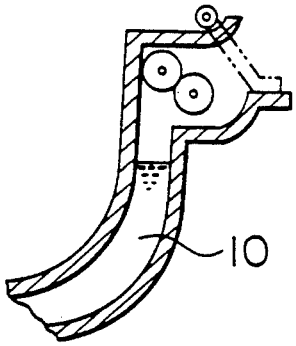

In FIG. 11, a sealing means is shown in which inert gas or liquid is filled or supplied onto the surface of the solution to cut off the solution from air. To be more specific, this sealing means cuts off the solution from air by making a divided space close to the entry and delivery port of the processing tank and filling the space with inert gas or liquid.

In order to fill the space with inert gas, it is necessary to form a sealed divided space at the upper portion of the processing tank 10. But in the case of supplying inert gas to the space, it is not necessary to seal up the space too tightly, and passage of the gas is formed from the entry port of the tank to the delivery port through the solution.

In the case of using liquid instead of inert gas, the specific gravity of the liquid must be lower than that of the solution. The liquid must not adhere to photosensitive materials and affect the processing solution.

When the inert gas or liquid is filled or supplied into the sealed space, the operation can be conducted tank by tank individually or the tanks can be operated all together.

Figure 12:
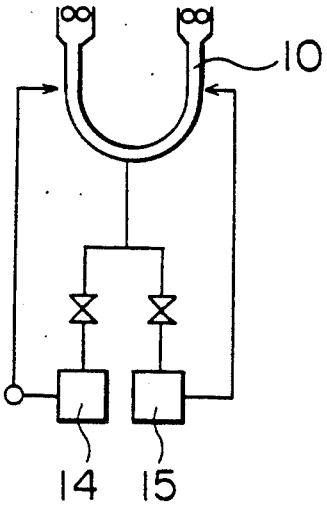

In FIG. 12, an example is shown in which a mechanism to discharge the solution out to the processing tank is installed and a means to detect the condition of photosensitive materials being conveyed, is also installed. When photosensitive materials do not exist in the tank for more than a prescribed time, the solution is discharged from the tank to a storage tank 14 such as a sealed container to prevent the solution from oxidizing. Whenever the solution is needed, it can be used again. There are two examples in returning the solution to the tank. One is to return the solution from the processing tank 10 to the storage tank 14. The other is to supply water from the water tank 15 to the processing tank 10 in order to replace the solution with water. When the apparatus is used again, water must be returned to the water tank 15 or discharged outside and the solution is supplied to the processing tank 10.

When the solution is replaced with water, it is useful to heat water to be supplied and to replace water in the processing tank 10 with heated water periodically in order to maintain the tank at a constant temperature. This method is useful to reduce waiting time to use the apparatus again.

There are variations to the example shown in FIG. 12 in which an storage tank to preserve the processing solution is installed outside the processing tank. Referring to FIG. 13 to FIG. 16, examples in which storage tanks are installed and the results of experiments conducted with the examples will be explained as follows.

The automatic developing apparatus and the processing method which refer to the example of this invention having a storage tank use a processing unit to dip-process silver halide photosensitive materials, and a storage unit to preserve processing solution under the condition that the solution substantially does not come into contact with air. Also, the apparatus and the method use a pump to circulate the solution between the processing unit and the storage unit. The apparatus are characterized by that the ratio of the area of the openings of the processing unit to the total cubic content of the processing solution in the processing unit and the storage unit is not more than 10 $cm^2$/liter.

In the case that an automatic developing apparatus which comprises a processing unit and a storage unit is used, processing solution is circulated between these units, and silver halide photosensitive materials are processed in a tube-shaped processing tank of the procesasing unit, a long photosensitive material tends to have a difference of developing quality between at the first and the last parts of the material because of the limited amount of the processing solution in the tank and the quick change of the chemicals of the solution such as main chemical and buffer.

However, since this example of the invention which comprises a storage unit has a structure that effective processing solution is always supplied into the processing unit, the above mentioned problems are solved. Moreover, the circulation of the processing solution in the example also brings a stirring effect of the solution, and minimize the processing time of the photosensitive material.

In this example, the ratio of the area of the openings of the processing unit to the total cubic content of the processing solution in the processing unit and the storage unit should be not more than 10 $cm^2$/liter. Preferably, the ratio is not more than 8 $cm^2$/liter: more preferably, it is not more than 6 $cm^2$/liter. By realizing this structure of the processing unit, developing defects by a long term preservation of the processing solution such as uneven developments and scratches on the photosensitive materials, and conveyance defects of the materials in the tank can be prevented.

Figure 13:
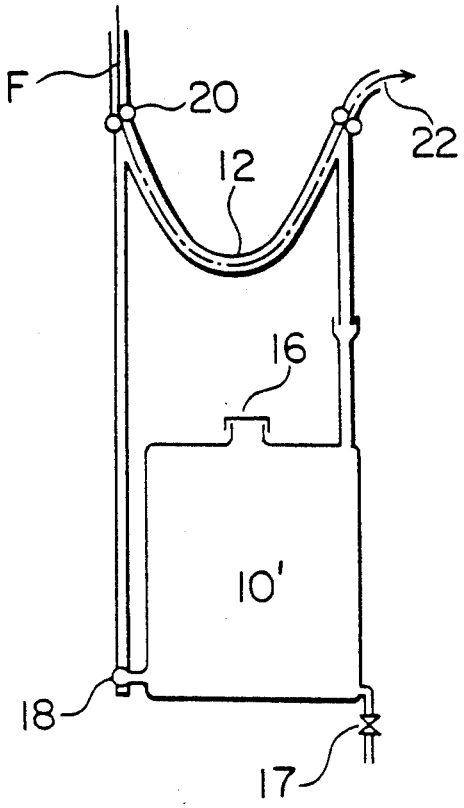

Referring now to FIG. 13 for a more complete understanding of the invention, the processing tank 12 is equipped with the storage tank 10'. The storage tank 10' has the processing solution supply port 16 and solution discharge port 17. Each storage tank has the pump 18 to circulate the solution.

Photosensitive materials are conveyed as shown by the arrow mark 22 in FIG. 13. Processing solution is circulated by the pump 18 and flows in the same direction as photosensitive materials. Even if processing solution flows in the reverse direction to the photosensitive materials, a remarkable deterioration of development efficiency can not be recognized. Therefore, processing solution may flow in the reverse direction. The rollers 20, made of soft materials, are located at the surface of the solution. Accordingly, the surface of the solution is sealed by the rollers 20 when photosensitive materials are not being processed in the apparatus.

Other examples are shown in FIG. 14(A) to FIG. 14(G).

As shown in FIG. 1 to FIG. 11, the surface of the solution can be sealed by different methods, apart from rollers.

Figure 14A:
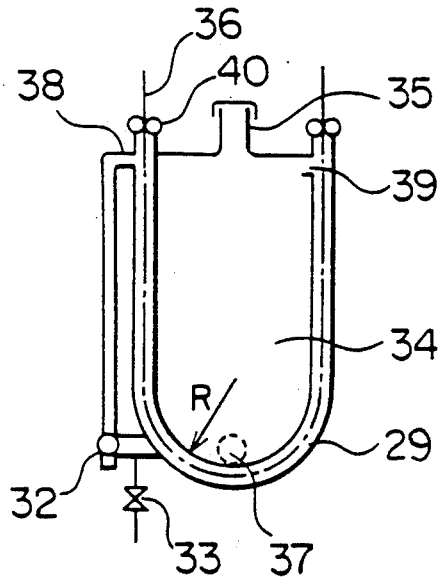
Figure 14B:
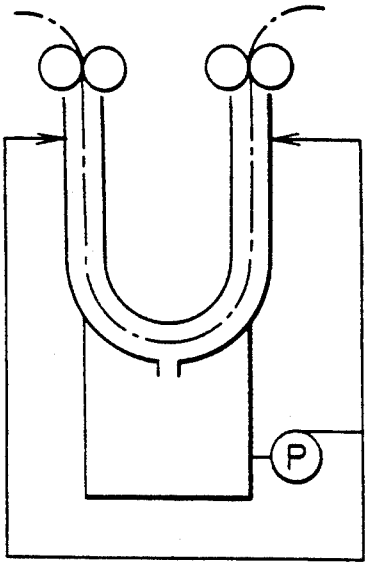
Figure 14C:
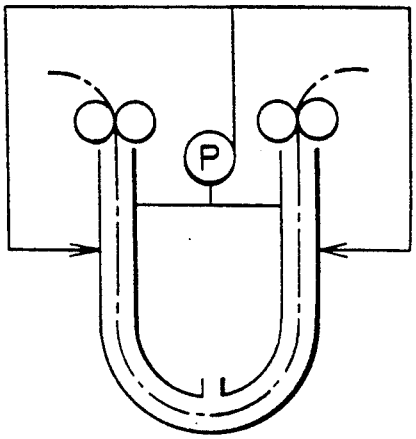
Figure 14D:
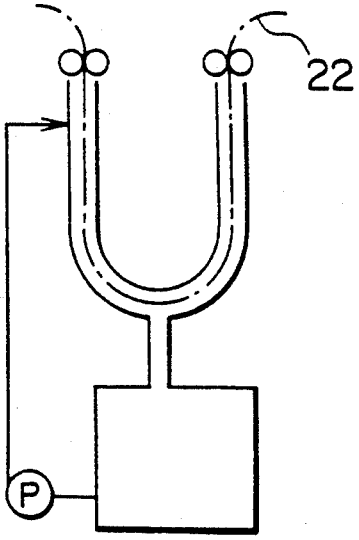
Figure 14E:
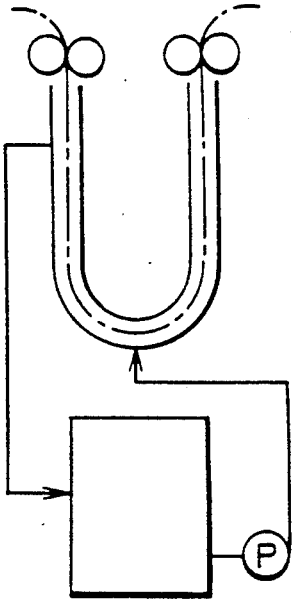
Figure 14F:
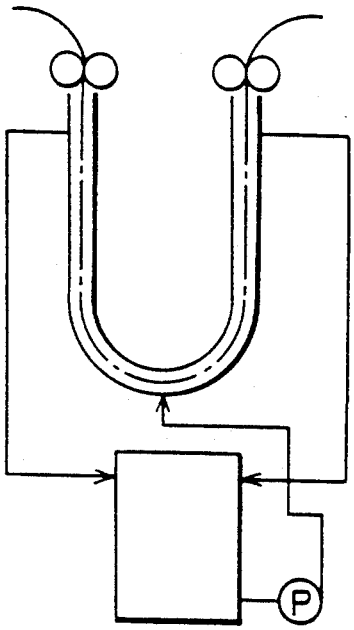
Figure 14G:
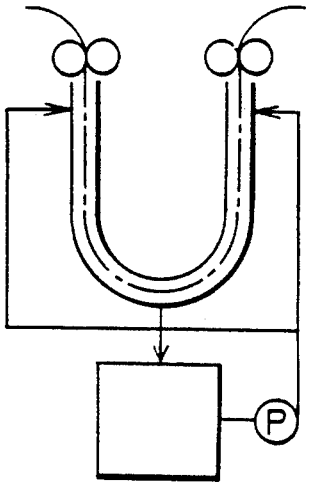

As shown in FIGS. 14(A) to 14(C), the storage tank 34 is located inside the processing tank 29 having supply port 35. The reason is that even when the apparatus is made compact, the photosensitive materials transport path must be at least a certain length. The solution is circulated as follows. Solution is supplied to the processing tank 29 from the suction port 37 of the storage tank 34 by the pump 32 through the port 38, and solution in the processing tank is returned to the storage tank 34. The solution is supplied to the storage tank 34 from the port 39. The solution is discharged from the discharge port 33. Silver halide photosensitive materials are supplied from the position represented by the numeral via conveyance rollers 40. In FIGS. 14(A) to 14(G), photosensitive materials are shown by dashed lines. Solution flows in the same direction as photosensitive materials are conveyed.

Figure 15:
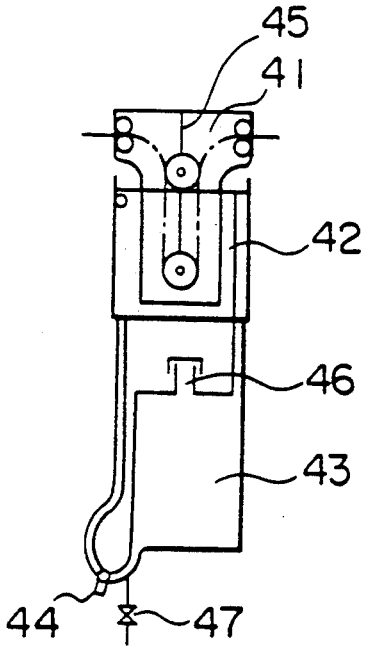

In FIG. 15, an example in which a rack is installed in the processing tank is shown. The rack 41 is dipped in the processing tank 42. The storage tank 43 is located under the processing tank 42. Processing solution is circulated by the pump 44 from the storage tank 43 to the processing tank in the same direction as photosensitive materials are conveyed.

When a baffleplate 45 is mounted in the rack 41, solution flows in the same direction as photosensitive materials are conveyed. So it is preferable to install the baffleplate in the rack, but it is not indispensable. The numeral 46 represents the solution supply port and the numeral 47 represents the solution discharge port.

Figure 16A:
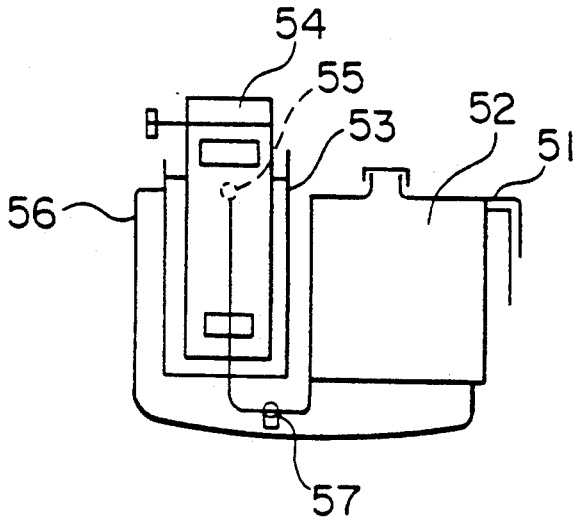
Figure 16B:
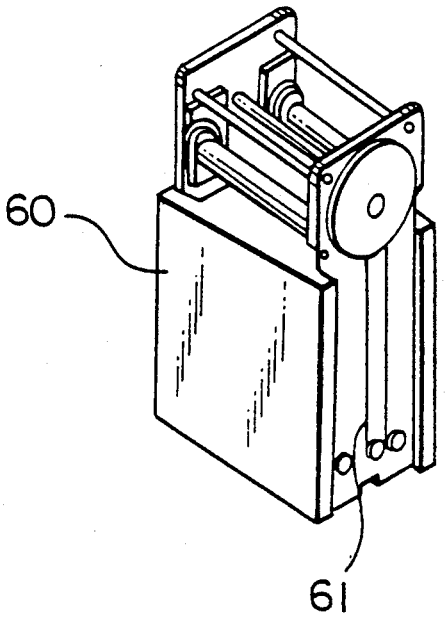
FIG. 16(B) is a perspective view of an element of the first embodiment.

FIG. 16(A) shows the case in which the processing tank and the storage tank are located so that the solution level of the processing tank and that of the tank are the same. This drawing is a view from the photosensitive material conveyance direction. This layout of tanks is preferable. The reason is that the height of the apparatus can be reduced and as a result it can be made compact. Furthermore, this tank layout is effective in shading the light. In FIG. 16(A), the numeral 51 is the solution supply port, the numeral 52 is the storage tank, the numeral 53 is the processing tank, the numeral 54 is the rack, the numeral 55 is the solution supply port from the storage tank, the numeral 56 is the solution return port from the processing tank to the storage tank, the numeral 57 is the pump, and the numeral 58 is the overflow port.

The auxiliary tanks shown in FIG. 13 to FIG. 16(A) are equipped with a solution supply port sealed by a lid, and the solution is filled to the level of the port. Therefore, the solution is sealed from the open air. The details of the rack 41 in FIG. 15 and the rack 54 in FIG. 16(A) are shown in FIG. 16(B). In FIG. 16(B), the numeral 60 is a block to reduce the space which is installed in the rack in order to reduce the capacity of the chemical processing tank and the numeral 62 is a belt to drive a bottom roller.

An experiment conducted with the equipment shown in FIG. 13 will be explained as follows. In this example, the developing tank, the bleaching tank, and the fixing tank are composed of the device shown in FIG. 13. In this developing device, the apertures of the processing tank 12 are located at the entry and delivery side of photosensitive materials. The cross section of the aperture of the tube-shaped processing tank is 35 mm×5 mm (1.75 $cm^2$). But the conveyance rollers are located at the surface of the solution, so the aperture area is not more than 1 $cm^2$.

The conveyance speed is 2 cm/sec. The capacity of the color development tank is 550 ml and that of the storage tank including the tube is 1.45 liters. The capacity of the processing tank for bleaching is 150 ml and that of the storage tank including the tube is 0.85 liter. The capacity of the processing tank for fixing is 150 ml and that of the storage tank including the tube is 0.85 liter. The capacity of the processing tank for stabilizing is 280 ml and that of the storage tank including the tube is 1.72 liters.

It is our intention that the structure of the processing tank, the construction of the photosensitive material conveyance system, the composition of the processing solution, setting of processing temperature and time, and so forth are not limited by any of the details of the description explained as follows. It is believed to be obvious that modification and variation of the following example is possible concerning improvement of processing efficiency or reduction of processing time relating to the composition of the processing solution.

An example of the composition of the processing solution, the structure of a processing tank, and processing time and temperature, will be explained as follows.

I. An Example of the Composition of the Processing Solution (1) Developer for color development Potassium carbonate: 33 g
Sodium hydrogencarbonate: 2.5 g
Potassium hydrogensulfite: 5.0 g
Sodium bromide: 1.4 g
Potassium iodide: 1.2 mg
Hydroxylamine hydrochloride: 2.5 g
Sodium chloride: 0.6 g
4-amino-3-methyl-N-ethyl-N-(β-hydroxylethyl) aniline sulfate: 4.8 g
Ethylenediamine tetramethylene phosphonic acid sodium: 3.0 g
Glacial potassium oxide: 1.2 g Before use, the above-given composition was dissolved in water to make one liter. The solution was adjusted to pH 10.06 by adding potassium hydroxide or 20% sulfuric acid.

(2) Bleach 1.3-propylene diamine tetraacetic acid ferric ammonium salt: 0.3 mol
Ethylene diamine tetraacetic acid 2 sodium: 10 g
Ammonium bromide: 150 g
Glacial acetic acid: 50 g Before use, the above-given composition was dissolved in water to make one liter. The solution was adjusted to pH 4.4 by adding ammonia or glacial acetic acid.

(3) Fixer

Ammonium thiosulfate: 200 g
Ammonium thiocyanate: 150 g
Anhydrous sodium bisulfite: 12 g
Meta sodium bisulfite: 2.5 g
Ethylene diamine tetraacetic acid 2 sodium: 1.0 g
Sodium carbonate: 10 g
Thiourea: 10 g Before use, the above-given composition was dissolved in water to make one liter. The solution was adjusted to pH 7.0 by adding acetic acid and ammonium.

(4) Stabilizer

| | |
|---|---|
| Hexamethylenetetramine | 2 g |
| 1.2-benzisothiazolone-3-one | 0.05 g |
| 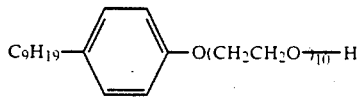 | 1 ml |

Before use, the above-given composition was dissolved in water to make one liter. The solution was adjusted to pH 7.5 by adding ammonium and 50% acetic acid solution.

II. An Example of the Processing Tanks (1) Color development
(2) Bleaching
(3) Fixing
(4) Stabilizing III. An Example of Processing Time and Processing Temperature

| | Time | Temperature (°C.) |
|---|---|---|
| (1) Color developing | 1'37" × 2 | 38 ± 0.3 |
| (2) Bleaching | 55" | 38 ± 5 |
| (3) Fixing | 55" | 38 ± 5 |
| (4) Stabilizing | 1'37" | Room Temp. |

EXPERIMENT 1

In the above-mentioned processing, the following color films were exposed to optical wedge light at 4800° K. and 5 CMS. Good results were obtained for all films.

1. Fuji Photofilm Company: Super HR II 100
2. Fuji Photofilm Company: Super HG 200
3. Fuji Photofilm Company: Super HG 400
4. Fuji Photofilm Company: Super HR II 1600
5. Eastman Kodak Company: Kodacolor Gold 100
6. Eastman Kodak Company: Kodacolor Gold 200
7. Eastman Kodak Company: Kodacolor Gold 400
8. Eastman Kodak Company: Kodacolor Gold 1600
9. Eastman Kodak Company: Ekta 25
10. Eastman Kodak Company: Press 400
11. Eastman Kodak Company: Press 1600
12. Konica Company: Konica Color GX II 100
13. Konica Company: Konica Color GX 200
14. Konica Company: Konica Color GX 400
15. Konica Company: Konica Color GX 3200

EXPERIMENT 2

An experiment was made with Konica Color GX II-100 using the same processing method as Experiment 1.

Uneven development, conveyance failure, and flaws on a film were investigated in the experiment. Occurrences of uneven development were investigated as follows. Five rolls of GX II-100 24Ex films were exposed to its maximum density and they were developed. The density of the films was measured with blue transmitted light by a Konica PAD 65 densitometer. The density varied at different portions of the films, and the difference between the highest density and the lowest density is shown in Table 1. Visual inspection also was conducted. The sample was put on a plate of frosted glass under which a 15 w fluorescent lamp was installed, and the density was inspected visually. The results are shown in Table 1.

TABLE 1

| No. | Auxiliary tank | Circulation pump | Sealing of tank | Unevenness: Within a month after solution was made | Unevenness: Solution was preserved for 2 months in a room. | Flaw | Failure of conveyance Solution was preserved for 2 months in a room. |
|---|---|---|---|---|---|---|---|
| 1. | No | No | No | 0.68 | 0.74 | X | X |
| 2. | Yes | No | No | 0.55 | 0.62 | X | X |
| 3. | Yes | Yes | No | 0.02 | 0.23 | ○ | Δ |
| 4. | Yes | Yes | Yes | 0.01 | 0.01 | ○ | Δ |

Remarks:
No. 1 and 2 are examples conducted for comparison.
No. 3 and 4 are examples of the present invention.
"No" means the equipment is not installed.
"Yes" means the equipment is installed.
The numerals means the difference between the highest density and the lowest density among the films which were exposed to their maximum density.
(Flaw)
X: there are more (Flaw) 3 scratches.
Δ: there are 1 or 2 scratches.
○: there are no flaws.
(Failure of conveyance)
X: unevenness of conveyance is obviously observed.
Δ: unevenness of conveyance occurs once per 10 minutes.
○: no unevenness of conveyance is observed.

Experiments were made on other negative color films and the same results were obtained.

As shown in Table 1, uneven development is prevented by circulating developer with a pump installed in the apparatus with a storage tank. Furthermore, conveyance failure can be avoided even when developer is preserved for a long time by sealing up the storage tank.

When experiments were made under the condition of sunshine, fogging of the unexposed portion was observed when the storage tank was not installed.

EXPERIMENT 3

Experiment 3 was made using the same method as Experiment 2. The experimental equipments shown in FIGS. 13 to 16 were used in Experiment 3. The results were the same as Experiment 2.

EXPERIMENT 4

The capacity of the chemical processing tanks was changed in this experiment. Although the method of the experiment was the same as Experiment 2, the experimental conditions were changed. They are shown in Table 2.

The capacity of processing solution was changed by changing that of the color development tank. The film conveyance speed in the processing tank was changed and the length and the sectional size of the tank were enlarged maintaining the ratio obtained by an experiment conducted beforehand. Uneven development was measured in the same way as Experiment 2.

TABLE 2

| No. | Capacity of tank (liter) | Experimental condition (Experimentation number in Experiment 1) | Within a day after solution was made: Development unevenness | 2 months since solution was made: Development unevenness | Flaw | Conveyance failure |
|---|---|---|---|---|---|---|
| 5 C | 20 | 1 | 0.03 | 0.04 | ○ | ○ |
| 6 I | 20 | 4 | 0.02 | 0.02 | ○ | ○ |
| 7 C | 10 | 1 | 0.16 | 0.25 | ○ | Δ |
| 8 I | 10 | 4 | 0.02 | 0.02 | ○ | ○ |
| 9 C | 5 | 1 | 0.59 | 0.64 | Δ | Δ |
| 10 I | 5 | 4 | 0.02 | 0.01 | ○ | ○ |
| 11 C | 2 | 1 | 0.78 | 0.88 | X | X |
| 12 I | 2 | 4 | 0.01 | 0.02 | ○ | ○ |
| 13 C | 1 | 1 | 0.84 | 0.95 | X | X |
| 14 I | 1 | 4 | 0.01 | 0.02 | ○ | ○ |

Remarks:
"C" means an experiment made for comparison.
"I" means an experiment of the present invention.
The meanings of signs ○, X, and Δ were explained before.

It can be said from the experiments that the present invention is more effective when a chemical processing tank smaller than 10 liters is used.

EXPERIMENT 5

Experiment 5 was made in the same way as Experiment 3, but upon the bleaching tank and fixing tank instead of the color developing tank. The results were almost the same as Table 2. There was little uneven development but flaws and conveyance failure increased.

EXPERIMENT 6

Experiment 6 was made in the same way as Experiment 4. The experimental equipment used in Experiment 6 were those shown in FIGS. 2, 3, and 4 instead of that shown in FIG. 1. The results were the same as those of Experiment 4.

EXPERIMENT 7

In the processes of bleaching, fixing, and stabilizing, the same results as Experiment 4 were obtained.

EXPERIMENT 8

Experiment 9 was conducted in the same way as Experiment 2 and Experiment 4. The position of the circulating pump was changed and the maximum density of blue transmitted light was measured. The results of the experiment is shown in Table 3.

TABLE 3

| Flow in processing tank | Processing time for color development | Maximum density measured with blue transmitted light |
|---|---|---|
| Direction of photosensitive materials | 3'14" | 2.16 |
| Reverse direction of photosensitive materials | 3'14" | 2.12 |
| Direction of photosensitive materials | 2'40" | 2.06 |
| Reverse direction of photosensitive materials | 2'40" | 2.01 |

The tendency shown in Table 3 is the same as other photosensitive materials. It is preferable that the processing solution in the processing tank flows in the same direction as the photosensitive conveyance. It is also preferable that the solution flows in the direction of conveyance of photosensitive materials in the bleaching and fixing processes.

EXPERIMENT 9

Instead of the above-mentioned examples, I to IV, an experiment was made using the following color developer, bleach-fixer, and stabilizer. Konica color QA Paper, Fuji Color Super FA Paper, and Eastman Kodak 2001 Paper were used as photosensitive materials in the experiment.

I'. An Example of the Composition of the Processing Solution

Color Developer
- Water: 800 ml
- Potassium chloride: 2.0 g
- Diethyl hydroxylamine: 5.0 g
- Diethylene triamine pentaaceticacid: 3.0 g
- Kodak CD-3: 6.0 g
- Potassium carbonate: 25 g
- Ethylene diamine tetrakis methylene phosphonic acid: 0.5 g
- Triethanolamine: 10 g Before use, the above-given composition was dissolved in water to make one liter. The solution was adjusted to pH 10.1 by adding KOH and sulfuric acid.

Bleach-fixer
- Ammonium sulfite: 14 g
- Ammonium thiosulfate: 70 g
- Ethylene diamine tetraacetate iron aqueous ammonium salt: 50 g
- Ethylene cyanic tetraacetate: 2 g Before use, the above-given composition was dissolved in water to make one liter. The solution was adjusted to pH 5.5 by adding glacial acetic acid and aqueous ammonium.

Fixer
- 5-chloro-2-methyle-4-isothiazoline-3-one: 0.02 g
- 2-methyle-4-isothiazoline-3-one: 0.02 g
- Ethylene glycol: 1.0 g
- 2-octyl-4-isothiazoline-3-one: 0.01 g
- 1-hydroxy ethyliden-1.1-diphosphonic acid (60% solution) 3.0 g
- $Bicl_3$ (45% solution): 0.65 g
- $MgSO_4$ $7H_2O$: 0.2 g
- 25% aqueous ammonium: 2.5 g Before use, the above-given composition was dissolved in water to make one liter. The solution was adjusted to pH 7.0 by adding aqueous ammonium and $H_2SO_4$.

II'. An Example of Processing Unit Composition

Color development (CD)
Bleach and fix (BF)
Stabilization (ST)

III'. An Example of Processing Time and Temperature

| | Processing time | Temperature | Capacity of tank |
|---|---|---|---|
| Color development (CD) | 45" | 35° C. | 2 liters |

-continued

| | Processing time | Temperature | Capacity of tank |
|---|---|---|---|
| Bleach and fix (BF) | 45" | 35° C. | 2 |
| Stabilization (ST) | 45" | 35° C. | 2 |

The experiment was made in the same way as Example 1. In this experiment, the width of photosensitive materials was 83 mm. Therefore, the width of the path was changed from 35 mm to 83 mm in FIG. 1. The length of the processing tank was changed in accordance with the processing time. The same results as Table 1 were obtained in the experiment, but flaws on the photosensitive materials and conveyance failure were a little more remarkable than Experiment 1.

The same experiments were made in connection with Experiment 3 to Experiment 9, and almost the same results were obtained. But as far as bleaching and fixing are concerned, the results were the same when the bleach-fixer was used.

In order to control the above-mentioned sealing means, a sensor should be located in the photosensitive materials transport path to detect its trailing end. After the prescribed seconds have passed from detection of the trailing end of photosensitive materials, the means to prevent solution from oxidation must be started or the means must be started when it is detected that the apparatus has not been used for more than the prescribed time. Furthermore, the operation can be conducted manually.

According to the above-mentioned first embodiment of the present invention, processing solution can be effectively prevented from oxidation and deterioration, even if the amount of solution is very small. This invention realizes a super small-sized automatic developing machine which will be used in the future. Therefore, the object mentioned before can be attained by the invention.

Referring to the attached drawings, the second embodiment of the present invention will be explained in detail as follows. In the drawings explained here, members which have the same function as in the first embodiment, are represented by the same number.

Figure 17:
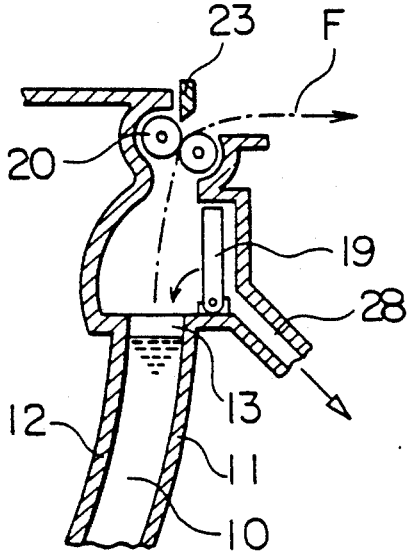
FIG. 17 to FIG. 20 are sectional views of the second embodiment of the present invention.
Figure 18:
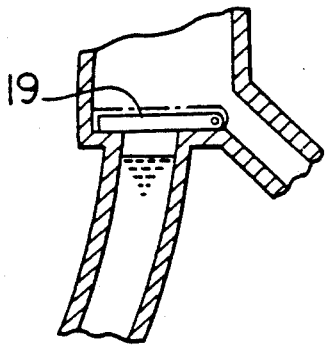

In FIG. 17 and FIG. 18, a cleaning water outlet is installed above the conveyance rollers, and cleaning water is supplied from the upper portion of the conveyance rollers to clean them.

In FIG. 17, the numeral 10 represents a processing tank consisting of the lower member 11 and the lid member 12 forming a slit-shaped passage. Processing solution is stored in a solution tank which is not shown, and it is pumped up by a pump from the tank and supplied to the processing tank 10 to the level of the surface 13 of solution. Photosensitive material F is dipped in the solution to be processed while being conveyed in the direction of an arrow mark from the entry side conveyance rollers which are not shown to the delivery side conveyance rollers 20.

This embodiment is related to cleaning of the conveyance rollers, especially the delivery side conveyance rollers 20. Therefore, the structure of the processing tank and the conveyance method can be applied to different embodiments from the one shown in the drawing.

The numeral 19 represents a cleaning water passage changing valve which changes the passage by being moved in the direction of the arrow mark. FIG. 17 shows the passage open, wherein photosensitive materials F can be conveyed. FIG. 18 shows the valve and the upper portion of the processing tank 10 closed, wherein the entrance of the bypass 28 is open.

In this condition, cleaning water is pumped up from a cleaning water tank which is not shown here and flows out from the cleaning water supply port 23. Consequently, the processing solution which adheres to the conveyance rollers 20, which are being idled, is washed away by the cleaning water and discharged to a drain tank not shown here through the bypass 28 or returned to the cleaning water tank.

As shown in FIG. 18, when the passage changing valve 19 is left closing the processing tank 10 after supply of cleaning water has been stopped, it is preferable some cleaning water is left on the valve 19 and seals up the upper portion of the processing tank 10.

Figure 19:
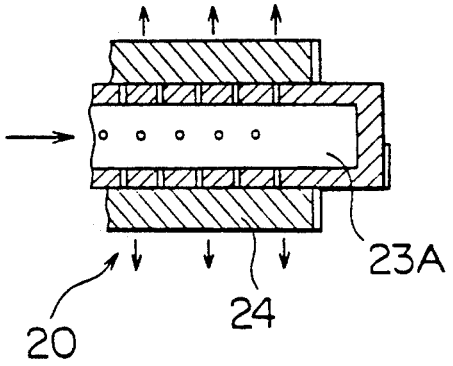

In FIG. 19, an example is shown in which cleaning water is supplied to the inside of the conveyance roller 20 and the roller is cleaned.

A hollow roller shaft 23A is adapted to form a passage to supply cleaning water. On the other hand, the roller 24 is preferably made of a foamed spongelike material. In this structure mentioned above, cleaning water supplied to the roller 24 oozes out of it and washes away processing solution which adheres to or sinks into the roller.

In the two examples of the second embodiment, water which has been prepared in a tank only for cleaning, can be utilized. But water which has been prepared for compensating evaporation, can also be used to clean the conveyance roller 20.

Furthermore, water used to clean the conveyance roller 20, can be discharged out of the tank through the bypass 28 mounted on the upper portion of the tank. But it is possible to change the passage by changing the valve 19, and clean the processing tank 10 by guiding the water used to clean the conveyance roller to the processing tank 10.

In the above-mentioned example, it is preferable that the cleaning water, after cleaning has started, is discharged outside through the bypass 28, and cleaning water after the prescribed time has passed, is guided to the processing tank 10 to clean it.

In each example, an operator can start cleaning the conveyance rollers 20 by operating a switch. But it is preferable to locate a sensor in the photosensitive material passage and to start cleaning according to the signal from the sensor after the prescribed time has passed from when the trailing end of photosensitive material F was detected.

Figure 20:
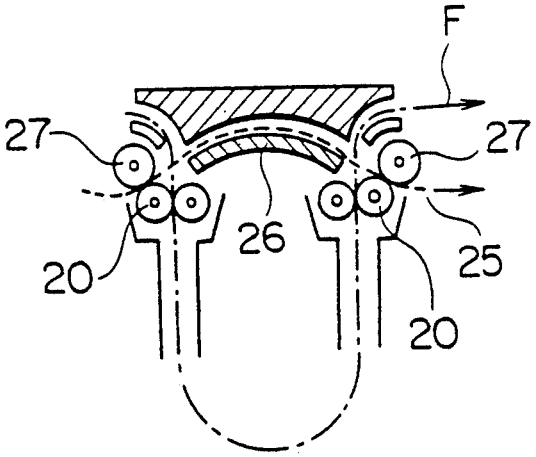

In FIG. 20, an example is shown in which the guide member 26 is located above the processing tank 10 to guide a roller cleaning paper 25, represented by a dotted line and the conveyance rollers 20 are cleaned through a different passage from that of photosensitive material F by changing the passage using the guide member 26.

In this example, as shown in FIG. 20, at least the delivery side conveyance rollers 20 are equipped with the third roller 27 which comes into contact with one of them, and a roller cleaning paper 25 can be guided by those rollers.

Furthermore, it is useful to use the third roller in the above-mentioned example as a cleaning roller.

Although this example is not shown in the drawing, the surface of the conveyance rollers 20 located at least at the delivery side of the storage tank 10, can be coated by hydrophobic materials such as Teflon resin to give a water repellent finish.

When the surface of the roller is coated by hydrophobic materials, it can be painted on the surface of the roller, or sheets of hydrophobic materials can be laminated around the surface of the roller. Anyway, the method to give a water repellent finish to the surface of a roller is not limited.

By giving a water repellent finish to the surface of a roller, less processing solution adheres to it. Therefore, it is not necessary to clean the roller 20 at the beginning and the end of every developing process. It is thought to be an advantage.

As a variation of the example shown in FIG. 20, processing solution is removed from the processing tank and the conveyance rollers and the tank are cleaned using the normal photosensitive material transport path.

Accordingly, in the second embodiment of the present invention, in an automatic developing apparatus for silver halide color paper in which the conveyance speed of silver halide color paper to be processed is 5 cm/min to 100 cm/min, the conveyance rollers are cleaned automatically or by very simple operation. Therefore, the object of the invention can be accomplished.

Figure 21:
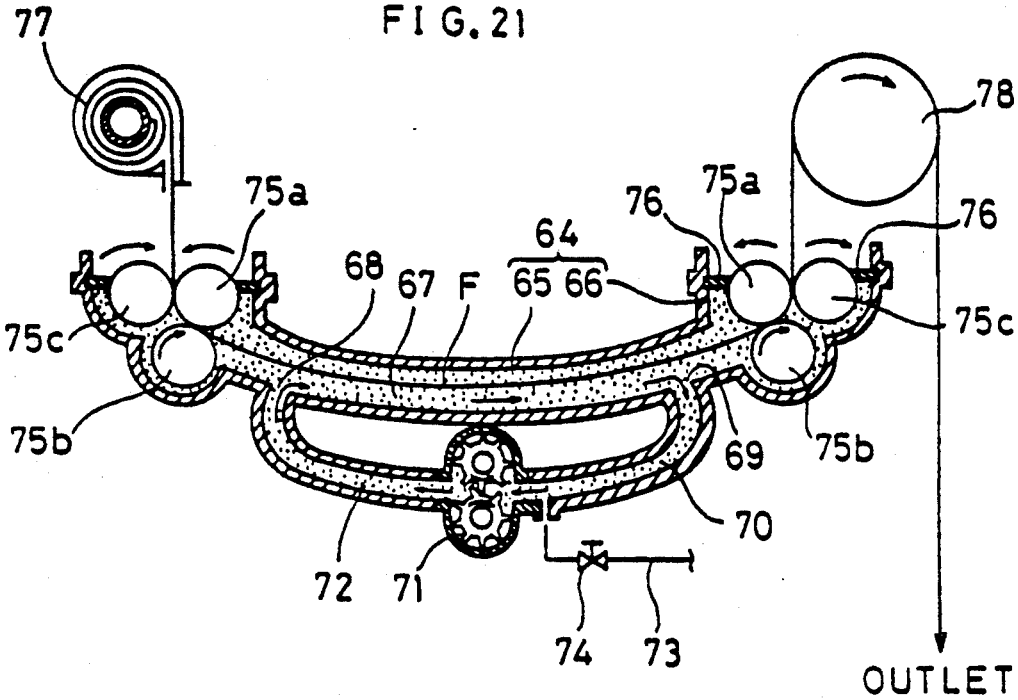
FIGS. 21 and 22 are sectional views of a third embodiment of the present invention.
Figure 22:
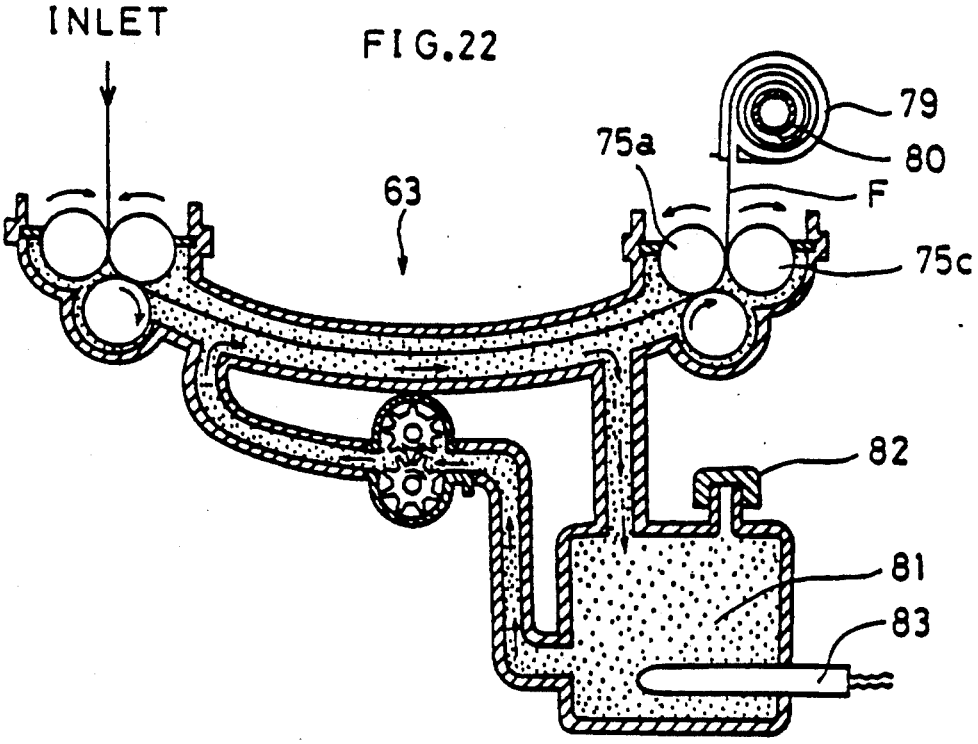

Practical examples of this invention to solve the above mentioned third problem are shown in FIGS. 21 & 22's sectional drawings to describe each outline. In FIG. 21, the sensitized material "F" is transported into the processor's tank, represented by elements 64–66 by a group of entrance transport rollers "75*a*", "75*b*" and "75*c*" in the tank "67". This auto developer is designed in structure so that the solution in the tank "67" is not discharged outside the tank by means of applying an appropriate hermetically sealing means at the entrance of the tank. The solution is circulated in the tank by the pump "71" in the same direction as the material "F"'s transport and at a faster speed in flow than that of material transport. Various types of pumps including a gear, tool, diaphragm, magnet, and impeller pump, can be used as the pump "71". In the practical example shown in FIG. 21, the solution tank unit consists of the pump "71", pump inlet piping "70" and pump outlet piping "72". If the volume of solution is not sufficient for the purpose, however, it is possible to provide an extra tank, circulation/processing solution tank "81" having a solution supply port "82" in communication with processing unit 63, as illustrated in FIG. 22. The extra tank "81" can be installed on the pump outlet side as well as on its inlet side. The material is treated in unit 63 and stored on photosensitive material winder 79 with shaft 80. Furthermore, a filter unit ot remove insoluble impurities contained in the solution in the way of the pump's inlet/outlet pipings (not shown in FIGS. 21 and 22) could be used. The heater "83" in the extra tank (FIG. 22) serves to regulate solution temperature in the processor tank. Solution temperature control is an extremely significant factor in the developing process of photographic emulsion. Besides the temperature regulation illustrated in FIG. 22, temperature control is possible as well through the wall surface of the processor "67", or by setting a thermal source on its inner wall surface.

Figure 23:
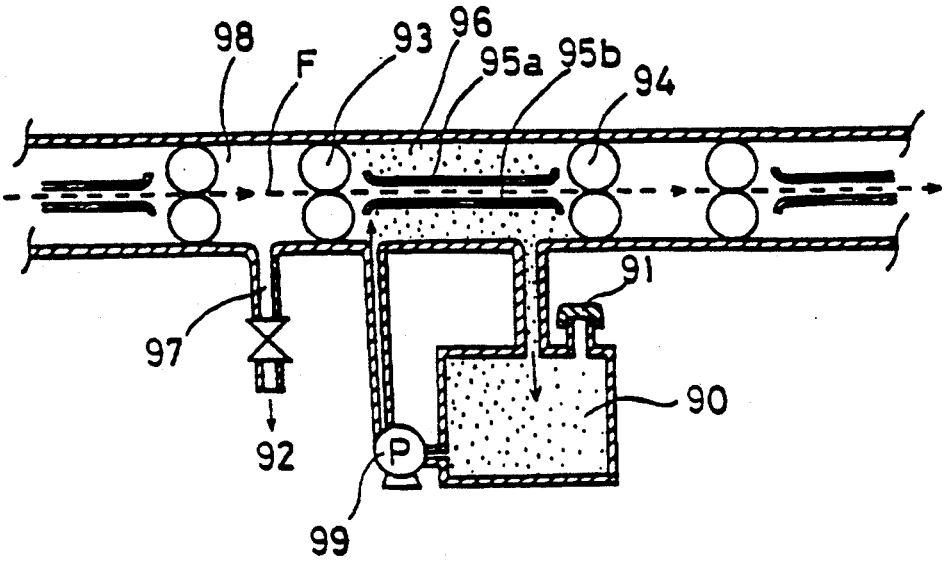
Figure 23:
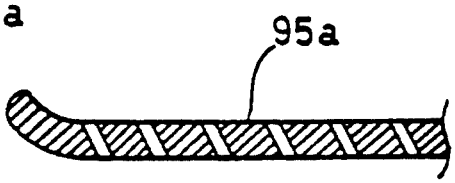
Figure 23:
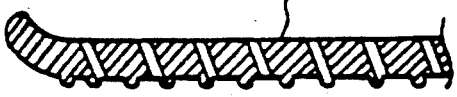
Figure 23:
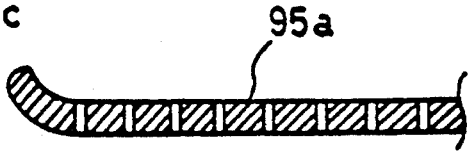

FIG. 23 illustrates an another practical example in which the rollers "93" and "94" for use in sensitized material transport constitutes a part of the processor tank's wall surface. The photosensitive material "F" is supplied by the delivery roller "93", and it advances towards the removal roller "94" while its transportation is regulated by the guides "95*a*" and "95*b*" in the tank. The solution in the processing tank "96" is circulated between the processor unit and the extra tank 90 with supply port 91 by the circulation pump "99" while maintaining the same direction both in material transport and solution flow. Additional measures for better performance can be incorporated in the guides "95*a*" and "95*b*" as indicated in FIGS. 24-*a*, 24-*b* and 24-*c*. FIG. 24-*a* illustrates a case where a certain number of holes is made in the guide to make the solution flow in the same direction to the material transport. In FIGS. 24-*b* and -*c*, tiny projections are devised (24-*b*), or something like textile is attached (24-*c*), respectively on the inner part of the guide, aiming at smoother transportation of the material in the processor tank.

In the FIG. 23 example, the processor tank "96" is interconnected by flanked by two similar tanks (positioned in front and behind) with a cleaning section "98" in between. Solution slightly leaked from the prior processor may remain in this cleaner portion, or water used to clean the roller surface may stay here; it can be drained through the discharge tube "97" and outlet 92. This cleaning section "98" also is substantially, hermetically sealed to prevent from deterioration of solution by aerial oxydization or evaporation, or from staining the roller "93". It is desirable to design the extra tank "90" so that its volume can be altered depending on the capacity of solution in use, but this condition is not always absolute. Another means of temperature control for the processor tank 96 is available by incorporating a thermal source in the circulation tank "90".

What is claimed is:

1. An automatic processing apparatus for processing a photosensitive material with a processing agent, comprising:

processing tank means for containing said processing agent therein, wherein said processing tank means has a tubular shape;

conveyance means for conveying said photosensitive material through said processing tank means; and sealing means for preventing said processing agent at an opening of said processing tank means from coming into contact with air, said sealing means comprising a processing agent draining means for draining said processing agent to a preservation tank means for preserving said drained processing agent therein, so that said processing agent is prevented from coming into contact with air, and wherein a ratio of an area of the opening to a cubic content of said processing agent is not more than 10 $cm^2$/liter.

2. The apparatus claimed in claim 1, wherein said conveyance means comprises a roller means for conveying said photosensitive material, and said roller means is further used as a part of said sealing means.

3. The apparatus claimed in claim 1, wherein said sealing means comprises a shutter means for closing an opening of said processing tank means so as to prevent said processing agent from coming into contact with air.

4. The apparatus claimed in claim 1, wherein said sealing means comprises a valve means for closing an opening of said processing tank means so as to prevent said processing agent from coming into contact with air.

5. The apparatus claimed in claim 1, wherein said sealing means comprises a flexible bag means placed between said processing agent and said processing tank means for covering an opening of said processing tank means so as to prevent said processing agent from coming into contact with air.

6. The apparatus claimed in claim 1, wherein said processing tank means comprises an upper member and a lower member, and said sealing means comprises a positioning means for increasing and decreasing the space between said upper member and said lower member.

7. The apparatus claimed in claim 1, wherein an area of said processing tank means between said sealing means and said processing agent retained in said processing tank means is filled with an inert gas.

8. The apparatus claimed in claim 1, wherein said sealing means further comprises a conveyance detection means for detecting conveyance of said photosensitive material to be processed in said processing tank means, wherein said processing agent in said processing tank means is drained by said processing agent draining means into said preservation tank when said conveyance detection means does not detect the conveyance of said photosensitive material in said processing tank means for a predetermined period of time.

9. The apparatus claimed in claim 1, wherein said conveyance means comprises a conveyance roller means, and a conveyance roller cleaning means for cleaning said conveyance roller means with water.

10. The apparatus claimed in claim 9, wherein said photosensitive material is a silver halide color paper, and said conveyance means conveys said photosensitive material at a conveyance speed between 5 cm/min and 100 cm/min.

11. The apparatus claimed in claim 9, wherein said conveyance roller cleaning means comprises a water supply means for pouring water onto said conveyance roller means, wherein said water supply means is located above said conveyance roller means.

12. The apparatus claimed in claim 11, wherein said conveyance roller means is water absorbent.

13. The apparatus claimed in claim 11, wherein the water which said water supply means pours on said conveyance roller means is further used for diluting said processing agent in said processing tank means.

14. The apparatus claimed in claim 11, wherein said conveyance roller cleaning means further comprises a water draining means between said conveyance roller means and said processing tank means.

15. The apparatus claimed in claim 11, wherein the water poured to clean said conveyance roller means is further used to clean said processing tank means.

16. The apparatus claimed in claim 11, wherein the water poured to clean said conveyance roller means in a predetermined period of time is drained through a water draining means, and the water poured to clean said conveyance roller means after said predetermined period of time is further used to clean said processing tank means.

17. The apparatus claimed in claim 11, further comprising a cleaning path member for providing a conveyance path for a cleaning paper which is different from that of said photosensitive material so that said conveyance roller means is cleaned with said cleaning paper.

18. The apparatus claimed in claim 11, wherein said conveyance roller means is cleaned with a cleaning paper conveyed through a path of said photosensitive material in said processing tank means after the processing agent in said processing tank means is drained therefrom.

19. The apparatus claimed in claim 17, further comprising a cleaning roller means for conveying said cleaning paper wherein said cleaning roller means contacts said conveyance roller means.

20. The apparatus claimed in claim 19, wherein said cleaning roller means is further used to clean said conveyance roller means.

21. The apparatus claimed in claim 9, wherein said conveyance roller means is covered with a hydrophobic material so that said conveyance roller means is water repellent.

22. The apparatus of claim 1, wherein the ratio of the area of the opening to the cubic content of the processing agent is not more than 6 $cm^2$/liter.

23. The apparatus of claim 1, wherein the cubic content of the processing agent in the processing tank means is less than 2 liters.

24. An automatic processing apparatus for processing a photosensitive material with a processing agent, comprising:

processing tank means for containing said processing agent therein;

conveyance means for conveying said photosensitive material through said processing tank means; and sealing means for preventing said processing agent at an opening of said processing tank means from coming into contact with air, wherein said processing tank means has a tubular shape, said photosensitive material is a silver halide, and said conveyance means conveys said photosensitive material at a conveyance speed between 5 cm/min and 100 cm/min, and wherein a ratio of an area of the opening to a cubic content of the processing agent is not more than 10 $cm^2$/liter.

25. The apparatus of claim 24 wherein said conveyance means comprises a roller means for conveying said photosensitive material and said roller means further comprises a part of said sealing means.

26. The apparatus of claim 24 wherein said sealing means comprises a shutter means for closing an opening of said processing tank means so as to prevent said processing agent from coming into contact with air.

27. The apparatus of claim 24 wherein said sealing means comprises a valve means for closing an opening of said processing tank means so as to prevent said processing agent from coming into contact with air.

28. The apparatus of claim 24 wherein said sealing means comprises a flexible bag means located between said processing agent and said processing tank means for covering an opening of said processing tank means so as to prevent said processing agent from coming into contact with air.

29. The apparatus of claim 24 wherein said processing tank means comprises an upper and a lower member, and said sealing means comprises a positioning means for increasing and decreasing the space between said upper and lower members.

30. The apparatus of claim 24 wherein an area of said processing tank means between said sealing means and said processing agent retained in said processing tank means is filled with an inert gas.

31. The apparatus of claim 24 wherein said sealing means comprises a processing agent draining means for draining said processing agent to a preservation tank means, for preserving said drained processing agent therein, so that said processing agent is prevented from coming into contact with air, and a conveyance detection means for detecting conveyance of said photosensitive material to be processed in said processing tank means, wherein said processing agent in said processing tank means is drained by said processing agent draining means into said preservation tank when said conveyance detection means does not detect the conveyance of said photosensitive material in said processing tank means for a predetermined period of time.

32. The apparatus of claim 24 wherein said conveyance means comprises a conveyance roller means and a conveyance roller cleaning means for cleaning said conveyance roller means with water.

33. The apparatus of claim 32 wherein said conveyance roller cleaning means comprises a water supply means for pouring water onto said conveyance roller means, wherein said water supply means is located above said conveyance roller means.

34. The apparatus of claim 33 wherein said conveyance roller means is water absorbent.

35. The apparatus of claim 33 wherein the water which said water supply means pours on said conveyance roller means is further used for diluting said processing agent in said processing tank means.

36. The apparatus of claim 33 wherein said conveyance roller cleaning means further comprises a water draining means located between said conveyance roller means and said processing tank means.

37. The apparatus of claim 33 wherein said water supplied to clean said conveyance roller means also cleans said processing tank means.

38. The apparatus of claim 33 wherein said water supplied to clean said conveyance roller means in a predetermined period of time is drained through a water draining means, and the water supplied to clean said conveyance roller means after a predetermined period of time is further used to clean said processing tank means.

39. The apparatus of claim 33 further comprising a cleaning path member for providing a conveyance path for a cleaning paper which is different from that of said photosensitive material so that said conveyance roller means is cleaned with said cleaning paper.

40. The apparatus of claim 33 wherein said conveyance roller means is cleaned with a cleaning paper conveyed through a path of said photosensitive material in said processing tank means after the processing agent in said processing tank means is drained therefrom.

41. The apparatus of claim 39 further comprising a cleaning roller means for conveying said cleaning paper wherein said cleaning roller means contacts said conveyance roller means.

42. The apparatus of claim 41 wherein said cleaning roller means is further used to clean said conveyance roller means.

43. The apparatus of claim 32 wherein said conveyance roller means is covered with a hydrophobic material so that said conveyance roller means is water repellent.

44. The apparatus of claim 24, wherein the ratio of the area of the opening to the cubic content of the processing agent is not more than 6 $cm^2$/liter.

45. The apparatus of claim 24, wherein the cubic content of the processing agent in the processing tank means is less than 2 liters.

* * * * *

UNITED STATES PATENT AND TRADEMARK OFFICE

CERTIFICATE OF CORRECTION

PATENT NO. : 5,043,756

DATED : August 27, 1991

INVENTOR(S) : Naoki Takabayashi et al.

It is certified that error appears in the above-identified patent and that said Letters Patent is hereby corrected as shown below:

Abstract, line 1, change "Disclosure" to --Disclosed--.

Signed and Sealed this

Seventeenth Day of November, 1992

*Attest:*

DOUGLAS B. COMER

*Attesting Officer*

*Acting Commissioner of Patents and Trademarks*